United States Patent [19]

Drigani

[11] Patent Number: 4,949,447

[45] Date of Patent: Aug. 21, 1990

[54] APPARATUS TO REPLACE SETS OF ROLLS AND RELATIVE EQUIPMENT IN ROLLING STANDS HAVING ROLLS SUPPORTED AS CANTILEVERS

[75] Inventor: Fausto Drigani, Zugliano (UD), Italy

[73] Assignee: Danieli & C. Officine Meccaniche SpA, Buttrio, Italy

[21] Appl. No.: 257,281

[22] Filed: Oct. 13, 1988

[30] Foreign Application Priority Data

Jun. 30, 1988 [IT] Italy ..... 83430 A/88

[51] Int. Cl.[5] ..... B23P 19/04

[52] U.S. Cl. ..... 29/252; 29/281.5

[58] Field of Search ..... 29/426.2, 402.08, 426.3, 29/252, 267, 281.1, 281.4, 281.5; 269/254 R, 71; 164/448; 72/239, 238

[56] References Cited

U.S. PATENT DOCUMENTS

| | | | |
|---|---|---|---|
| 3,328,973 | 7/1967 | Scheib | 72/239 |
| 3,595,556 | 7/1971 | Schonauer | 269/71 |
| 3,700,228 | 10/1972 | Peale | 269/71 |
| 3,926,422 | 12/1975 | Wilson | 269/71 |
| 4,012,825 | 3/1977 | Granitz et al. | 72/239 |
| 4,262,891 | 4/1981 | Kinney | 269/71 |
| 4,411,053 | 10/1983 | Scheurecker | 29/267 |
| 4,811,935 | 3/1989 | Tamura et al. | 269/71 |

FOREIGN PATENT DOCUMENTS

| | | |
|---|---|---|
| 1545751 | 10/1968 | France . |
| 1508599 | 4/1978 | United Kingdom . |

*Primary Examiner*—Robert C. Watson

*Attorney, Agent, or Firm*—Wegner & Bretschneider

[57] ABSTRACT

Apparatus (10) to replace sets of rolls and relative equipment in rolling stands having rolls supported as cantilevers, which is able to take from the stand the sets of rolls and relative equipment complete and already used and to deliver to the stand new sets of rolls and relative equipment complete and already prepared, positioned and adjusted, the sets of rolls and relative equipment consisting of the rolls, relative equipment, supports and everything else which can be replaced whenever the rolls are changed, the apparatus (10) comprising in reciprocal cooperation a support device (15), at least one positioner assembly (20) and, at least momentarily, at least two support units (21), the positioner assembly (20) being able to move so as to place opposite and position correctly a support unit (21) in relation to the rolling stand (11).

21 Claims, 5 Drawing Sheets

APPARATUS TO REPLACE SETS OF ROLLS AND RELATIVE EQUIPMENT IN ROLLING STANDS HAVING ROLLS SUPPORTED AS CANTILEVERS

This invention concerns an apparatus to replace the sets of equipment, namely the assembly consisting of the rolls, rings, guides, guide bars, supports and relative equipment, in rolling stands having rolls supported as cantilevers.

To be more exact, the invention concerns an apparatus suitable to dismantle and assemble the whole consisting of the rolls supported as cantilevers in a horizontal or vertical rolling stand and also of the sets of equipment, guides for the rolled stock and the means to support such equipment and guides; the above whole forms the set of equipment of such rolling stand having rolls supported as cantilevers.

With this apparatus it is possible to position and install or dismantle the above set of equipment at the same time in one single operation, thus facilitating the operations of maintenance and of changing the rolled section to be produced.

Apparatus exists in the state of the art to change the sets of rolls of a rolling stand having its rolls supported as cantilevers; such apparatus performs only the engagement of the two rolls and leaves the relative equipment and supports where they are.

The relative equipment and supports are then removed separately by hand or with other known means. GB No. 1,508,599 discloses a device which is hung on a crane or bridge crane and serves to handle heavy rolls.

This device is actuated by hand and comprises claw elements the annular protrusions of which are able to engage each roll at one of the grooves included to shape the bars; this device is actually a large gripper with a plurality of claws.

The device is suitable to take and move only one roll at a time.

As we said earlier, the state of the art provides for the replacement of the rolls and relative equipment to be carried out in at least two steps with separate removals of the rolls and of the relative equipment, thus entailing a great waste of time.

Next, it should be borne in mind that each element to be fitted has to be aligned with the other elements and therefore this operation causes a great waste of the time of the personnel thus employed.

FR No. 1.545.751 comprises a device able to take rolling rolls from stands having their rolls supported as cantilevers and to place the rolls on stationary supports. This device can also carry out the reverse operation.

The device includes a hydraulic gripper able to engage the top of the roll to be removed and provides for only one roll to be engaged and carried at a time.

Means are not provided which are suitable to engage the whole set consisting of the rolls, relative equipment and the supports of such equipment. The handling is carried out by a bridge crane with a rotary turret.

Moreover, the removal of the rolls and relative equipment takes place in an uncoordinated manner in the state of the art, so that the parts are normally deposited at random in the storehouse.

In the state of the art the parts have always to be taken one by one from the storehouse so as to be re-fitted to the rolling stands.

Our present invention offers an apparatus to replace the sets of rolls and relative equipment on rolling stands with the greatest of ease and speed.

The apparatus to replace the sets of rolls and relative equipment on rolling stands having rolls supported as cantilevers according to the invention is set forth in the main claim, while the dependent claims disclose variants of the idea of the basic solution.

According to the invention an apparatus is provided which can perform simultaneous withdrawal of the set of rolls complete with the relative equipment from the rolling stand. This apparatus cooperate with suitable means in carrying out correct positioning and reciprocal alignment with the rolling stand.

The invention provides in a position near to the rolling stand to be serviced an assembly to position the set of rolls and relative equipment, this assembly employing units to support and reciprocally position the components of such set.

This set according to the invention is pre-arranged on the support units with its components reciprocally disposed, spaced apart and aligned.

By means of the apparatus according to the invention it is enough to locate the positioner assembly correctly in relation to the rolling stand so as to have the various components of the set already prepared for working when they have been clamped to the stand.

Likewise, the withdrawal of the set of rolls and relative equipment from the rolling stand is carried out by means of the positioner assembly which constitutes the apparatus of this invention, in such a way that after withdrawal the set is properly positioned on the positioner assembly.

According to the invention the apparatus consists not only of at least one positioner assembly but also of at least two support units, one of which serves for the withdrawal of a set of rolls and relative equipment, while the other serves for the fitting and correct positioning of a new set on the stand to be re-equipped.

Each support unit comprises engagement and alignment means with pre-set jaws able to engage at one and the same time the various components of the set such as the rolls, relative equipment and the support of the equipment.

According to the invention the apparatus includes also a support device able to support, position and move the positioner assembly.

According to the invention the sets of rolls and relative equipment to be fitted to the stands to be re-equipped are arranged on a support unit and kept ready and waiting. This operation is carried out while rolling is in progress with a set already located on the rolling stand.

At the end of the rolling cycle in progress the set of rolls and relative equipment to be replaced is engaged by the other support unit, which has been brought close for this purpose and been positioned in relation to the rolling stand, the set in question being withdrawn by means of a movement axial to the rolls.

Steps are then taken to replace one support unit with the other, for instance by rotation of the positioner assembly, and the support unit holding the new required set of rolls and relative equipment is brought up to and aligned with the rolling stand and delivers this new set to the stand itself.

The new set is installed on the stand with a suitable movement, and then the positioner assembly bearing the replaced set of rolls and relative equipment is distanced and disposed as desired on the support device.

By means of the invention the times for changing the sets of rolls and relative equipment are greatly reduced since the new sets are pre-arranged and pre-positioned during the preceding rolling step; moreover, the times required to engage and withdraw a set to be replaced are very short.

According to the invention, therefore, the apparatus includes a specially equipped positioner assembly and units to support and position the set of rolls and relative equipment.

The specially equipped support unit comprises a device to support, position and handle the support units.

The support unit includes means for swift clamping and positioning of the various components and also means for positioning and alignment in relation to the rolling stand.

We shall describe hereinafter preferred embodiments of the invention as a non-restrictive example with the help of the attached figures, in which:

FIG. 1 gives a side view of the apparatus according to the invention for a stand having its rolls supported as cantilevers with horizontal axes;

FIG. 2 shows a side view of the apparatus according to the invention for a stand having its rolls supported as cantilevers with vertical axes;

FIGS. 3*a* and 3*b* show a side view of the apparatus according to the invention for a stand having its rolls supported as cantilevers with vertical axes in a variant of FIG. 2;

The attached figures show a rolling stand 11 with rolls 12 supported as cantilevers, possible adapters 13 and a motor 14.

Figure 1:
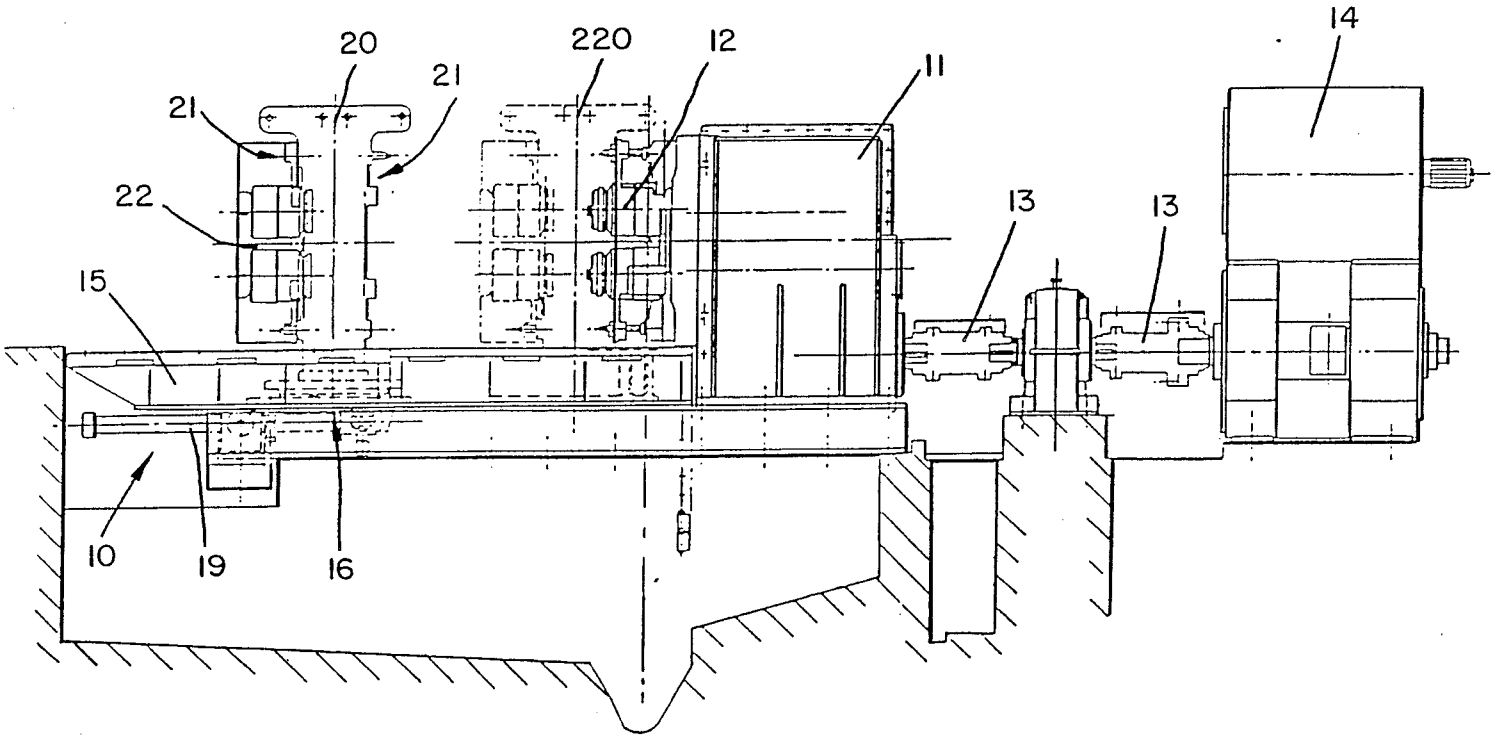
Figure 2:
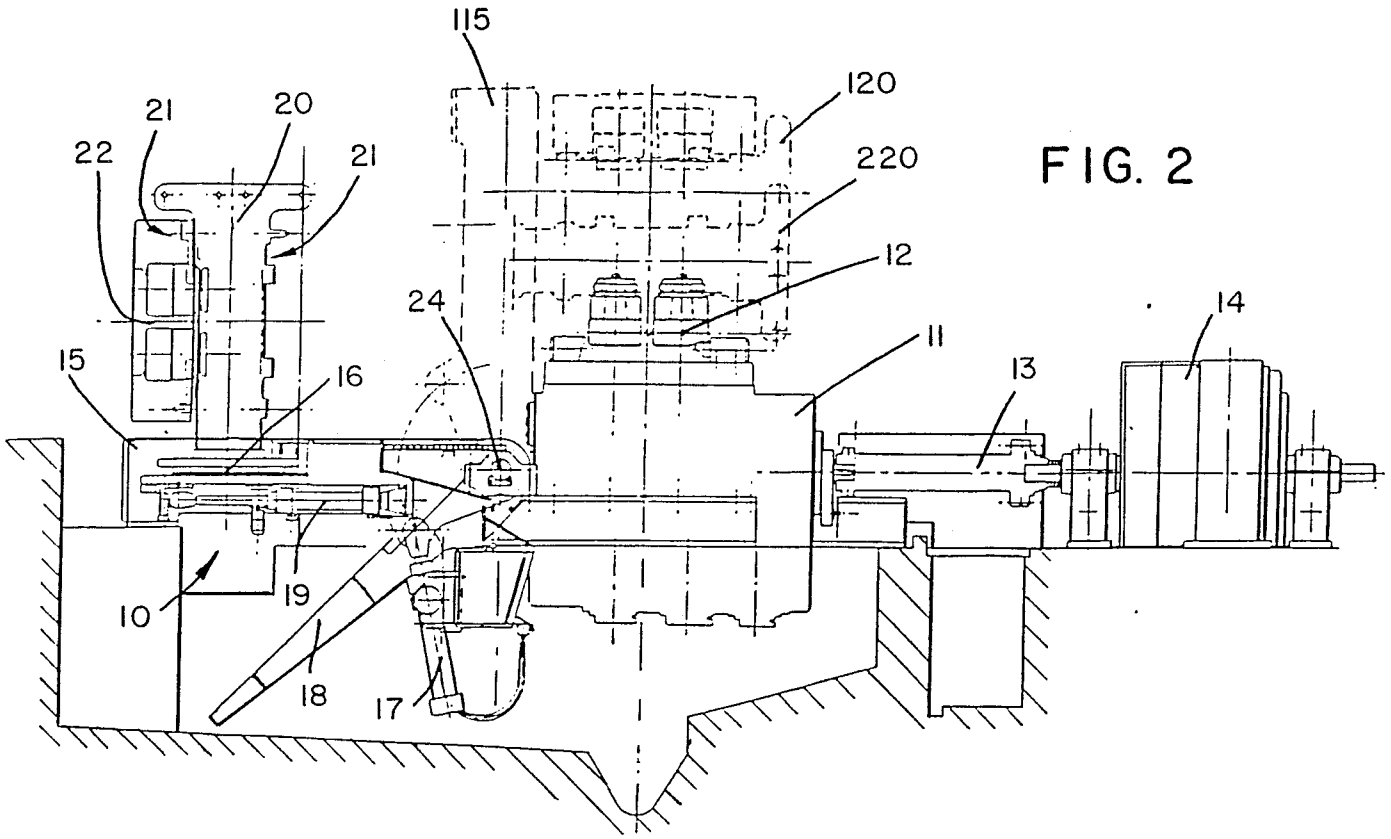
Figure 3A:
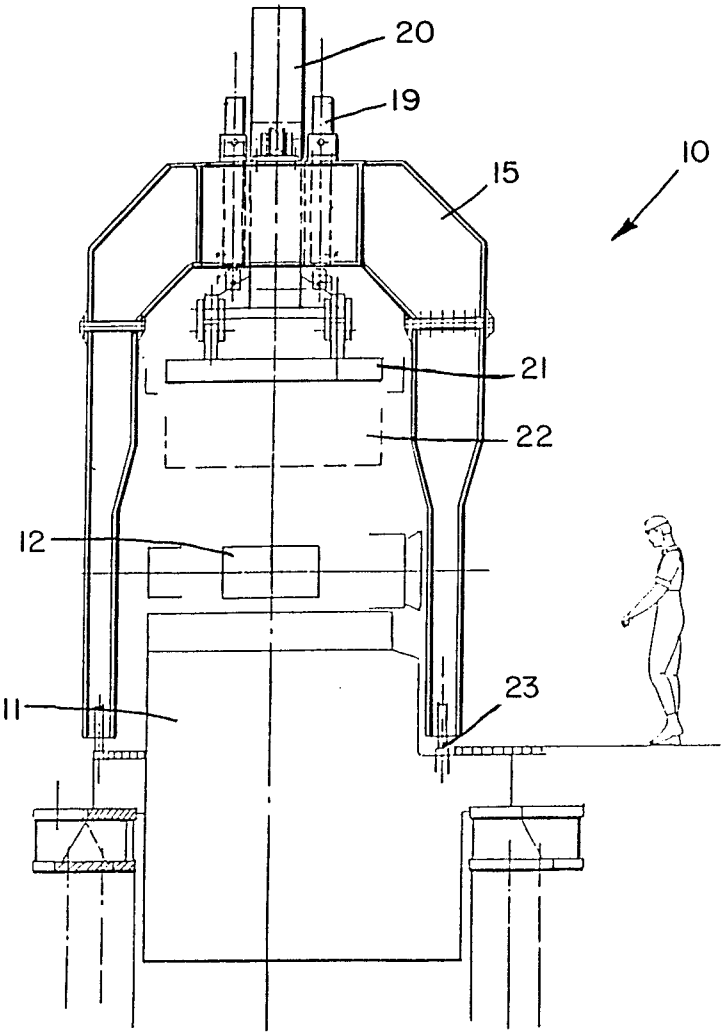
Figure 3B:
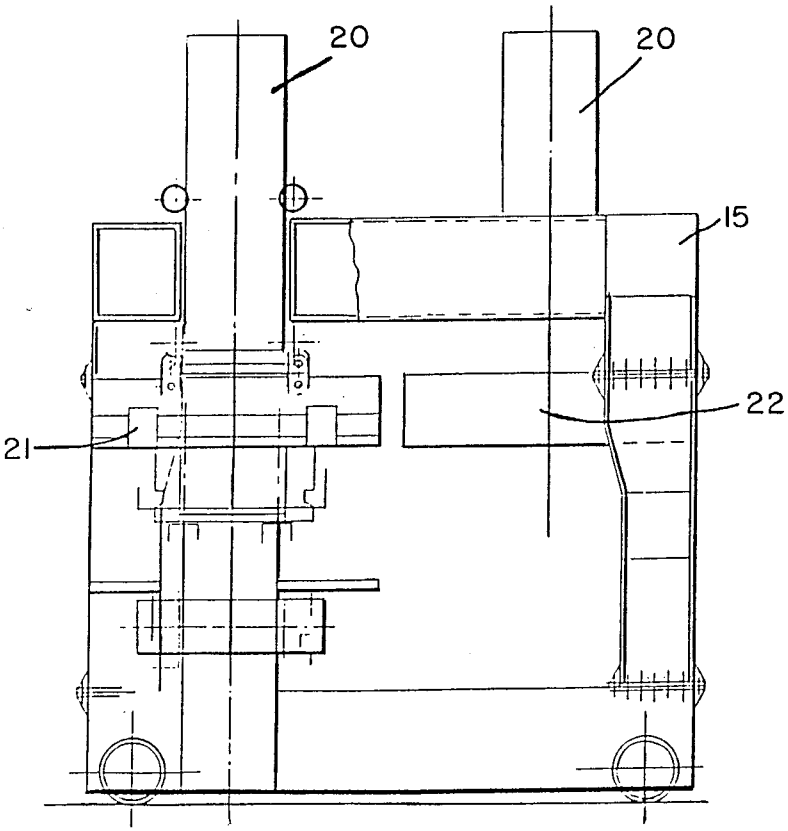

The rolling stand 11 may include rolls 12 supported as cantilevers with a horizontal axis (FIGS. 1 and 4) or with a vertical axis (FIGS. 2 and 3).

A support device 15 with which there cooperates at least one positioner assembly 20 that comprises at least one support unit 21 is included in cooperation with the stand 11.

The positioner assembly 20 is able to move so as to take up a position of direct cooperation with a set of rolls and relative equipment 22 already positioned on, or to be positioned on, the rolling stand 11, and also to take up an inactive position.

While the rolling stand 11 is at work, the set of rolls and relative equipment 22 to process the next rolled section is pre-arranged on a support unit 21.

The support unit 21 may be integrally fixed to the positioner assembly 20 or be capable of being dismantled and installed elsewhere for the better pre-arrangement of a set of rolls and relative equipment 22, already complete and geometrically coordinated and positioned, on that support unit 21.

If the support unit 21 is arranged elsewhere, it is fitted to the positioner assembly 20 as soon as it has been completed with its set 22.

When the rolling stand 11 has finished its working cycle with the set of rolls and relative equipment 22 then fitted to the stand, a support unit 21 which does not hold such a set 22 is positioned in cooperation with the set already present on the rolling stand 11.

This support unit 21 may be positioned in relation to the rolling stand 11 by positioner pins and abutments (not shown here) and proceeds to connect itself to the rolling stand 11 so as to cooperate directly with the set of rolls and relative equipment 22 present on the stand 11.

When the support unit 21 has been connected to the set of rolls and relative equipment 22 on the stand 11, that set is disconnected from the stand 11 and the support unit 21 can be removed.

The removal of the support unit 21 is performed by the positioner assembly 20 which bears that unit 21 and which arranges to position and align in front of the rolling stand 11 another support unit 21 complete with a new set of rolls and relative equipment 22.

When the new support unit 21 has been positioned and aligned, the new set 22 can be fitted to the stand 11, which is thus ready at once for the next rolling cycle.

The support device 15 in FIG. 1 cooperates with the base of the rolling stand 11 and extends parallel to the axes of the rolls 12.

The positioner assembly 20 is located on the support device 15 and can move therealong and comprises at its two sides two support units 21 respectively.

The positioner assembly 20 is installed on a rotary platform 16 and can be moved in front of the rolls 12 by a displacement ram 19.

For the removal of the set of rolls and relative equipment 22 positioned on the stand 11 the positioner assembly 20 brings to the stand 11 a support unit 21 not containing a set 22 by moving from position 20 to position 220 and by employing suitable positioner pins and abutments for accurate alignment and positioning.

When the support unit 21 has been firmly secured to the set 22 located on the stand 11, the positioner assembly 20 retires by a suitable distance from the stand 11 and is then rotated substantially by 180° by the rotary platform 16; the assembly 20 thus takes a new support unit 21 complete with a new set of rolls and relative equipment 22 to the stand 11 and is brought close to the latter by the displacement ram 19.

When the set 22 has been transferred onto the stand 11, the positioner assembly 20 withdraws to its inactive position.

The positioner assembly 20 can be left in its inactive position or be dismantled and taken elsewhere.

Likewise, the support units 21 can be integrally fixed to the positioner assembly 20 or be capable of being dismantled and re-installed as required.

FIG. 2 shows a rolling stand 11 having rolls 12 with a vertical axis. A support device 15 is included with the rolling stand 11 and comprises a rotation pivot 24 and cooperates with a lifter jack 17.

A movable door 18 is also included and closes the space left free by the support device 15 when the latter is rotated substantially by 90° to become positioned substantially parallel to the axis of the rolls 12.

When the support device 15 reaches position 115 where it is substantially parallel to the axis of the rolls 12, the positioner assembly 20 reaches position 120, whereas position 220 is that for removal and delivery of a set of rolls and relative equipment 22 from and to the rolling stand 11.

The positioner assembly 20 can be rotated about its axis with the support device 15 in a vertical position 115 or with the support device 15 rotated momentarily into a horizontal position.

The choice between these two positions for rotation of the positioner assembly 20 to bring a new support unit 21 in front of the rolling stand 11 will depend on the strength of the structure of the support device 15 and the power of the lifter jack 17 and rotary platform 16.

FIG. 3 shows another rolling stand 11 with rolls having vertical axes, but the support device 15 is conformed here as a portal and the positioner assembly 20 performs a vertical movement with the help of the displacement rams 19; in this example there are two positioner assemblies 20 and the portal-type support device 15 can move in a straight line in relation to the rolling stand 11.

Thus one positioner assembly 20 bears a support unit 21 already holding a set of rolls and relative equipment 22, whereas the other positioner assembly 20 comprises a support unit 21 not holding a set 22.

The support units 21 may be stationary or may advantageously be removable from the positioner assembly 20 so that the set of rolls and relative equipment can be handled more easily.

For installation and removal of the sets 22 the support device 15 can take up two positions corresponding to the two positioner assemblies 20, of which one 20 serves to remove a set 22 already used, whereas the other 20 serves to deliver a new set 22.

Guide rails 23 cooperating with the portal-type support device 15 are included at the sides of the rolling stand 11.

Figure 4:
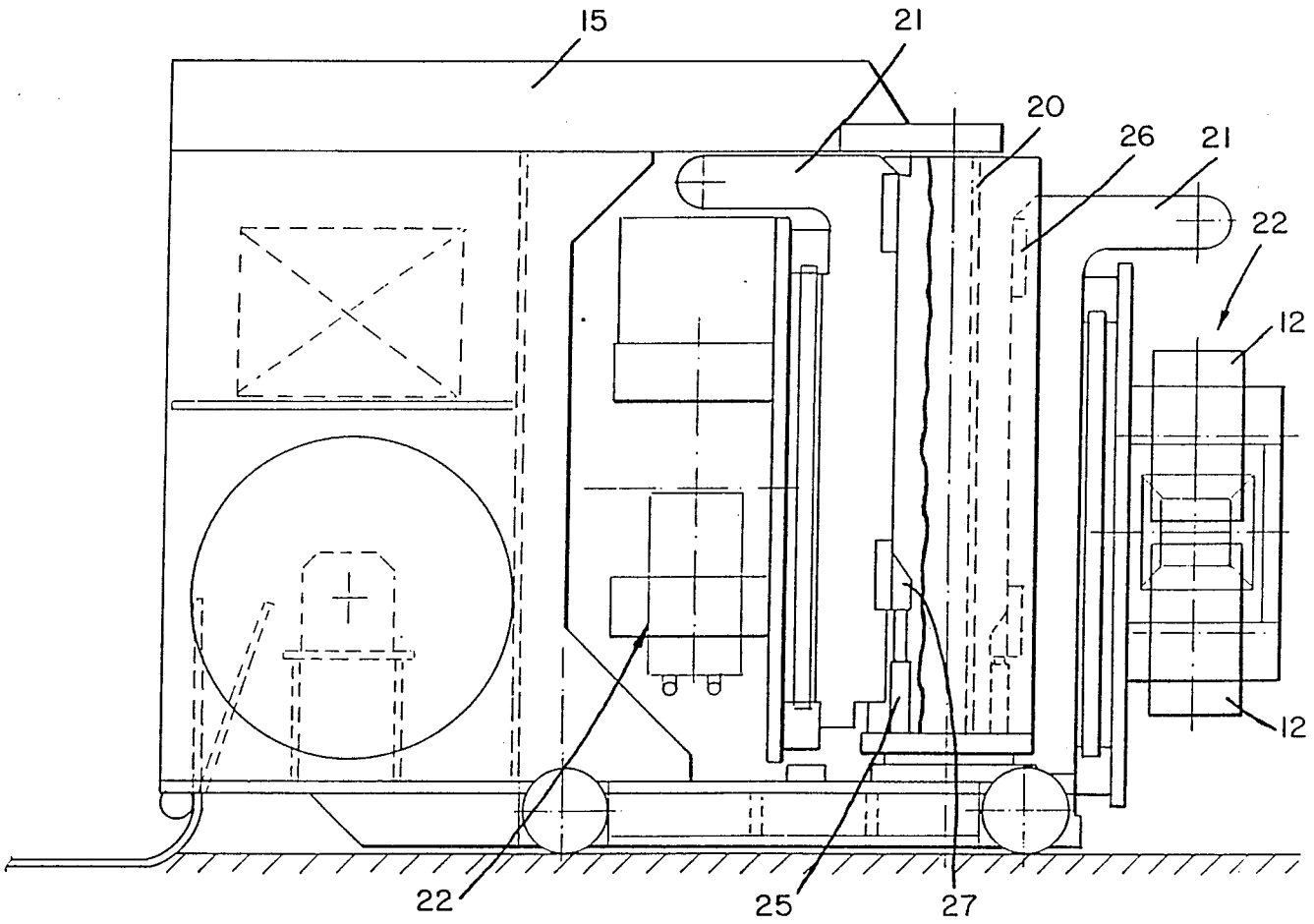
FIG. 4 shows a side view of the apparatus according to the invention for a stand having its rolls supported as cantilevers with horizontal axes in a variant of FIG. 1.

FIG. 4 shows a support device 15 able to move in front of the rolling stand 11 and comprising a positioner assembly 20 with two support units 21.

In this example the positioner assembly 20 is able to rotate by 180° about its vertical axis and comprises support units 21 which are not only replaceable but also have two vertical positions. These vertical positions are respectively a position for installing and pre-arranging a set of rolls and relative equipment 22 and a position for removing and delivering a set 22 from and to the rolling stand 11.

A jack 25 cooperating with an abutment 27 and with sliders 26 able to slide in suitable guides provided in the positioner assembly 20 enables these two vertical positions to be reached so that the horizontal axis of the support unit 21 can be lowered as much as possible, as indeed is necessary with such rolling stands 11 having such rolls 12.

The two vertical positions are made necessary so as to provide enough strength for the base of the apparatus.

The support device 15 may be fed through a suitable electrical cable and may include within itself all the controls needed for its positioning and displacement.

Figure 5:
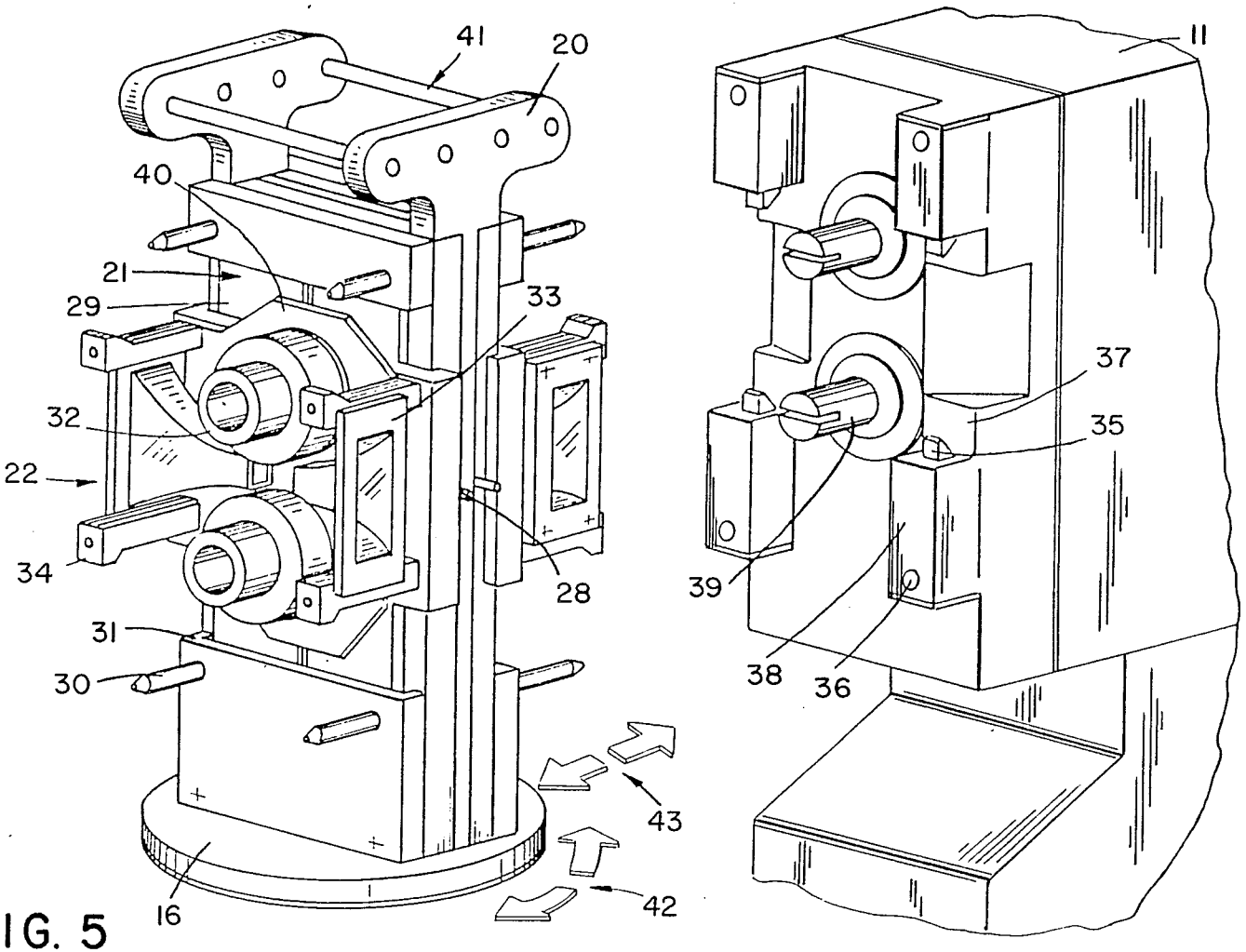
FIG. 5 shows a three-dimensional diagram of the invention applied to the embodiment of FIG. 1.

FIG. 5 shows an example of the positioner assembly as applied to the embodiment of FIG. 1. The interchanges are easy to understand when the idea of the embodiment of the solution has bee grasped.

The positioner assembly 20 comprise two support units 21, each of them equipped with two jaws 29 suitable to position and secure not only the two rolls 32 but also the relative equipment 33 and the support 44 of that equipment 33.

The jaws 29 slide in guides 31 and can be actuated by anchorage screws 28.

The jaws 29 clamp and position the rolls 32 in cooperation with appropriate grooves provided in the rolls. Thus they clamp and position the relative equipment 33 and the support 40 of that equipment by acting on appropriate seatings in the elements forming the set of rolls and relative equipment 22.

When the whole set 22 has been clamped by the jaws 29 to the support unit 21, it is possible to place the other support unit 21 against the rolling stand 11 by rotating the positioner assembly 20.

The positioner assembly 20 is positioned in relation to the stand 11 by means of positioner pins 30; to achieve this, the positioner pins 30 cooperate with positioner holes 36 and possibly with a positioner abutment 38.

Next, securing screws 28 are employed to clamp the jaws 29 to the set of rolls and relative equipment 22 located on the stand and, when clamping catches 35 which are anchored to projecting feet 34 of the support 40 of the equipment and which clamp those feet to a support surface 37 have been disengaged, it is possible to withdraw the whole set of rolls and relative equipment 22.

The positioner assembly 20 is moved backwards according to the arrow 43, is rotated according to the arrow 42 and positions opposite the stand 11 the other support unit 21 complete with the new set of rolls and relative equipment 22.

The positioner assembly 20 may comprise appropriate attachments 41 for removal and positioning purposes by means of a hoist, crane or another means.

The rolls 32 are inserted directly onto shafts 39 and are clamped with known rapid clamping means.

The word "equipment" 33 is to be understood as meaning the entry and exit guides, oval turners, other guides and all the means in general which are auxiliary to the rolls 32 for proper rolling.

What is claimed is:

1. Apparatus for replacing sets of rolls and relative equipment on a rolling stand having rolls supported on cantilevered shafts, comprising:

a support device;

at least one positioner assembly adapted to cooperate with the rolling stand;

means for movably mounting said at least one positioner assembly on said support device;

support means for supporting the rolls and relative equipment of the rolling stand comprising at least two support units; and support unit mounting means for removably mounting said support means on said at least one positioner assembly;

wherein said positioner assembly is movable in reciprocal relation with the rolling stand between a first position wherein the rolls of one of said at least two support units are aligned with the cantilevered shafts of the rolling stand and a second position wherein the positioner assembly is disengaged from the rolling stand.

2. Apparatus as claimed in claim 1, wherein each said support unit is movable and positionable on said positioner assembly.

3. Apparatus as claimed in claim 1, further comprising means for moving said movably mounted positioning assembly on said support device.

4. Apparatus as claimed in claim 3, wherein said means for moving comprises at least one displacement ram.

5. Apparatus as claimed in claim 1, further comprising rotation means for rotating said positioning assembly about a vertical axis.

6. Apparatus as claimed in claim 5, wherein said rotation means comprises rotary platform.

7. Apparatus as claimed in claim 1, wherein said positioner assembly is anchored to said support device.

8. Apparatus as claimed in claim 1, wherein said positioner assembly is removable from said support device.

9. Apparatus as claimed in claim 1, wherein said support device is movable relative to the rolling stand.

10. Apparatus as claimed in claim 9, wherein said support device is moveable in a straight line.

11. Apparatus as claimed in claim 10, further comprising means for moving said support device in a straight line.

12. Apparatus as claimed in claim 9, wherein said support device is movable along an arc of a circle having a horizontal axis.

13. Apparatus as claimed in claim 12, further comprising means for moving said support device along an arc of a circle having a horizontal axis.

14. Apparatus as claimed in claim 13, wherein said means for moving said support device comprises a ram.

15. Apparatus as claimed in claim 1, wherein each said support unit comprises reciprocal alignment and positioning means.

16. Apparatus as claimed in claim 1, wherein each said support unit comprises engaging means for engaging the rolls and relative equipment.

17. Apparatus as claimed in claim 16, wherein said engaging means comprises jaws to clamp and position the rolls and relative equipment.

18. Apparatus as claimed in claim 16, wherein each said support unit further comprises an equipment support having a plurality of feet and means for anchoring and positioning the relative equipment.

19. Apparatus as claimed in claim 18, wherein said plurality of feet comprise projections for cooperating with a plurality of clamping catches for clamping and positioning the relative equipment.

20. Apparatus as claimed in claim 1, wherein each said support unit comprises a male-female positioner means for reciprocal positioning with the rolling stand.

21. Apparatus for replacing sets of rolls and relative equipment on a rolling stand having rolls supported as cantilevers, comprising:

a support device;

a positioner assembly adapted to cooperate with the rolling stand;

means for movably mounting said at least one positioner assembly on said support device;

support means for supporting the rolls and relative equipment of the rolling stand comprising at least two support units; and support unit mounting means for removably mounting said support means on said positioner assembly;

wherein said positioner assembly is movable in reciprocal relation with the rolling stand between a first position wherein the rolls of one of said at least two support units is aligned with the cantilevered shafts of the rolling stand and a second position wherein the positioner assembly is disengaged from the rolling stand;

wherein said means for movably mounting comprises a rotation means for rotating said positioner assembly about a vertical axis and means for moving said positioner assembly in a straight line; and wherein each said support unit comprises engaging means for engaging the rolls and relative equipment and an equipment support having a plurality of feet and means for anchoring and positioning the relative equipment.

* * * * *